US007520091B2

(12) United States Patent
Friedman

(10) Patent No.: US 7,520,091 B2
(45) Date of Patent: Apr. 21, 2009

(54) ADAPTABLE ROOF SYSTEM

(76) Inventor: Daniel B. Friedman, 132 Clearview Rd., Dewitt, NY (US) 13214-1217

( * ) Notice: Subject to any disclaimer, the term of this patent is extended or adjusted under 35 U.S.C. 154(b) by 811 days.

(21) Appl. No.: 10/887,446

(22) Filed: Jul. 9, 2004

(65) Prior Publication Data

US 2006/0005473 A1 Jan. 12, 2006

(51) Int. Cl.
*E04B 1/12* (2006.01)

(52) U.S. Cl. ..... 52/63; 52/222; 52/18; 52/5; 52/75; 52/78; 52/64; 52/3; 52/6; 52/66; 47/17; 160/84.06; 135/90; 135/96; 135/119

(58) Field of Classification Search ..... 52/222, 52/18, 5, 75, 78, 63, 64, 3, 6, 66, 83; 47/17; 160/84.06; 135/90, 96, 119
See application file for complete search history.

(56) References Cited

U.S. PATENT DOCUMENTS

| | | | |
|---|---|---|---|
| 2,052,217 | A | 8/1936 | Sibour |
| 2,126,413 | A | 8/1938 | Respess |
| 2,603,171 | A | 7/1952 | Smith |
| 2,642,162 | A | 6/1953 | Tobias |
| 2,692,566 | A | 10/1954 | Mitchell |
| 3,009,211 | A | 11/1961 | Hansen |
| 3,213,571 | A | 10/1965 | Olson |
| 3,288,158 | A | 11/1966 | Gugliotta |
| 3,534,511 | A | 10/1970 | Cappella |
| 3,608,252 | A | 9/1971 | Bisson |
| 3,766,691 | A | 10/1973 | Ray |
| 4,174,594 | A | 11/1979 | Panzini et al. |
| 4,175,361 | A | 11/1979 | Kumode et al. |
| 4,257,199 | A | 3/1981 | Kuboyama |
| 4,262,460 | A | 4/1981 | Bertin et al. |
| 4,348,833 | A | 9/1982 | Nagoya et al. |
| 4,566,475 | A | 1/1986 | Wund et al. |
| 4,587,775 | A | 5/1986 | Lewis et al. |
| 4,616,451 | A | 10/1986 | Glick |
| 4,676,033 | A | 6/1987 | Allen et al. |
| 4,682,449 | A | 7/1987 | Berger |
| 4,706,419 | A | 11/1987 | Adachi et al. |
| 4,716,691 | A | 1/1988 | Allen et al. |
| 4,727,688 | A | 3/1988 | Kida et al. |
| 4,738,057 | A | 4/1988 | Logan et al. |
| 4,751,800 | A | 6/1988 | Kida et al. |
| 4,783,861 | A | 11/1988 | Leurent et al. |
| 4,802,314 | A | 2/1989 | Schildge, Jr. |
| 4,831,792 | A | 5/1989 | Berger |
| 4,833,837 | A | 5/1989 | Bonneau et al. |
| 4,844,109 | A | 7/1989 | Navarro |
| 4,920,707 | A | 5/1990 | Moskaliuk et al. |

(Continued)

*Primary Examiner*—Jeanette E Chapman
*Assistant Examiner*—Daniel Kenny
(74) *Attorney, Agent, or Firm*—Marjama Muldoon Blasiak & Sullivan LLP

(57) ABSTRACT

A bang-bang servo system controls motors which provide drive for trucks on each end of a fabric support beam structure. A plurality of such truck/beam/fabric units comprise a retractable roof Separation of inner and outer truck guiding tracks/support platforms may be wide and somewhat variable. The radius of curvature of the inner and outer tracks may vary widely over the beam excursion path between open and closed roof conditions. Individual beam motion sequencing and stop position are commanded through a central control unit. These features allow great flexibility and adaptability in application of this invention.

21 Claims, 11 Drawing Sheets

U.S. PATENT DOCUMENTS 4,936,060 A 6/1990 Gelinas et al.
4,942,698 A 7/1990 Kumagai et al.
4,995,203 A 2/1991 Brisbin et al.
5,007,214 A 4/1991 Itami et al.
5,010,695 A 4/1991 Schildge, Jr.
5,027,565 A 7/1991 Sugizaki et al.
5,035,093 A 7/1991 Parazader et al.
5,058,332 A 10/1991 Masuyama et al.
5,062,243 A 11/1991 Kumagai et al.
5,063,730 A 11/1991 Muramoto et al.
5,103,600 A 4/1992 Geiger et al.
5,117,594 A 6/1992 Muramoto et al.
5,167,097 A 12/1992 Robbie et al.
5,187,894 A 2/1993 Ripley, Sr. et al.
5,189,851 A 3/1993 Omika et al.
5,203,125 A * 4/1993 Sugizaki ..... 52/66
5,209,029 A 5/1993 Foerst
5,224,306 A 7/1993 Cramer
5,257,481 A 11/1993 Reppas et al.
5,257,485 A 11/1993 Kawaguchi et al.
5,297,368 A 3/1994 Okada
5,351,449 A 10/1994 Allen et al.
5,371,983 A 12/1994 Kawaguchi et al.
5,394,660 A 3/1995 Haris
5,653,066 A 8/1997 Schildge, Jr.
5,682,711 A 11/1997 Warczak
5,743,347 A 4/1998 Gingerich et al.
5,746,028 A 5/1998 DiBenedetto
5,778,603 A 7/1998 Reppas
5,848,499 A 12/1998 Schildge, Jr.
5,896,708 A * 4/1999 Doi et al. ..... 52/66
5,927,022 A 7/1999 Hirakawa et al.
5,983,575 A 11/1999 Reppas
6,003,269 A 12/1999 McRee
6,082,054 A 7/2000 Silberman et al.
6,089,341 A 7/2000 Gingerich et al.
6,109,283 A * 8/2000 Burke et al. ..... 135/129
6,202,355 B1 3/2001 Uram et al.
6,253,494 B1 7/2001 Shaffron
6,345,638 B1 2/2002 Warner et al.
6,367,206 B1 4/2002 Silberman et al.
6,415,556 B1 7/2002 Silberman et al.
6,453,500 B1 * 9/2002 Schmitt ..... 15/97.3
6,502,593 B1 1/2003 Stafford
6,566,834 B1 5/2003 Albus et al.
6,591,593 B1 7/2003 Brandon et al.
6,647,692 B1 11/2003 Roder et al.
6,669,346 B2 12/2003 Metcalf
6,698,141 B2 3/2004 Silberman et al.
6,718,696 B2 4/2004 Silberman et al.
6,754,994 B2 6/2004 Jahanpour et al.
6,776,178 B1 8/2004 Glynn et al.
6,789,360 B2 * 9/2004 Silberman et al. ..... 52/66
6,809,495 B2 10/2004 Rodnunsky
6,826,452 B1 11/2004 Holland et al.
6,843,261 B2 1/2005 Gillis
6,851,227 B1 2/2005 Schildge, Jr.
6,873,465 B2 3/2005 Groot et al.
6,875,089 B2 4/2005 Hall et al.
6,886,471 B2 5/2005 Rodnunsky
D506,240 S 6/2005 Tseng et al.
6,945,003 B2 9/2005 Berry
6,952,900 B2 10/2005 Leurent et al.
6,966,741 B2 11/2005 Gay et al.
6,998,617 B2 2/2006 D'Emilio et al.
7,012,637 B1 3/2006 Blume et al.
7,056,119 B2 6/2006 Cabato et al.
7,088,071 B2 8/2006 Rodnunsky
7,127,861 B2 10/2006 Arbel et al.
D533,179 S 12/2006 Milstein et al.
7,149,549 B1 12/2006 Ortiz et al.
7,180,529 B2 2/2007 Covannon et al.
7,181,312 B2 2/2007 Takehara et al.
7,183,554 B2 2/2007 Gallagher et al.
D538,808 S 3/2007 Landau
D540,817 S 4/2007 Milstein
7,206,662 B2 4/2007 Sparenborg et al.
7,210,160 B2 4/2007 Anderson, Jr. et al.
D543,255 S 5/2007 Lerner et al.
7,215,830 B2 5/2007 Knee et al.
D544,104 S 6/2007 Grotbeck
7,239,106 B2 7/2007 Rodnunsky et al.
7,267,240 B2 9/2007 Maurer et al.
7,289,876 B2 10/2007 Lussen et al.
7,293,881 B2 11/2007 Kasahara et al.
7,313,462 B2 12/2007 Woodruff et al.
D560,265 S 1/2008 Dalland et al.
D562,425 S 2/2008 Dalland et al.
7,333,113 B2 2/2008 Gordon
2004/0261953 A1 * 12/2004 Hart ..... 160/80

* cited by examiner

ADAPTABLE ROOF SYSTEM

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The advantages of fabric retractable roofs relative to solid element retractable roofs are: small mass to be moved, variability of applicable roof shapes, adaptability to existing facilities, and low cost (especially where snow/ice melting and tight weather seals are not an issue). Yet fabric retractable roofs (other than automobile convertible tops and shade awnings) are not commonly used. The reason is to be found in the complexity of the proposed systems, principally with respect to fabric handling and transport means.

The object of this invention is to provide a simple fabric transport means having no inherent fabric wear inducing characteristics. The simplicity of the preferred embodiments not only makes the invention applicable to covering a wide range of facilities, but in some instances offers portability (ease of dismantle/move/reassemble).

BRIEF SUMMARY OF THE INVENTION

The movable roof is comprised of a plurality of facility-spanning movable beams each supporting fabric sections. Transport is supplied by beam end support trucks running on substantially parallel track platforms. The first preferred embodiment of this invention is a "one sided" configuration with substantially horizontal support beams. The roof slope, required for rain or snow/ice melt runoff on one side, is based on each fabric section cut for slope along its center fold seam. If required, runoff catching gutter means can be attached to the platform support means beneath the lower fabric edge.

Each beam end support truck moves on rolling members, wheels or glide rollers, on a guide track. The truck drive means is an electric motor which either directly drives a wheel axle or, in the preferred embodiment (not relying on friction), drives a pinion gear linked to a rack paralleling the guide track. Clamp assemblies attached to each truck connect to rolling members in near contact with the platform underside. This is required to handle extraordinary situations, e.g. strong winds or system component failure where lift or twisting forces attempt to separate the truck from its track. For each truck a motor-stop signaling means is located on its associated platform resulting in motor turnoff/braking at the desired intermediate or "roof closed" positions. For widely separated platforms, spanning beams are comprised of truss structures, and fabric sections are comprised of overlapping horizontal strip segments.

A servo system controlling the motors at both beam ends consists of

1) An angle error signal sensor on either the inner or outer truck providing an electrical signal to control circuitry.

2) Control circuitry processing the error signal in order to provide error correcting drive to the lagging motor.

3) Electrical motors, necessary electrical cabling, cable handling means.

4) Raw power conversion circuitry, beam sequencing circuitry, and safety circuitry. Angle error is measured with respect to the perpendicular between the beam and track path tangent.

While continuous (linear or nonlinear) error sensing is possible, the resulting servo control circuitry and power control circuitry are complex and costly. The preferred embodiment is a bang-bang servo system employing angle error limit sensors and single phase AC gear-motors. Under bang-bang servo control, while accelerating and decelerating, the average velocity of each beam end is in proper ratio. That is, proportional to the local radius of curvature of the associated platform. Since at any instant either end of the beam may be leading the other, a means to accommodate small rotation of the beam-to-truck connection is required. This is accomplished via a turret means on each truck base. Further, due to associated non-perpendicularity of the beam and track path tangent, a means is required to accommodate small additional beam length variation. To accomplish this, one beam end is connected to its turret on a pin and bearings allowing only relative rotation of the beam about the pin in a vertical plane. The other beam end turret has an open channel member pinned to it also allowing relative vertical plane rotation motion only. The associated beam end passes through the open channel member and rides on low friction bearings therein providing freedom of translational motion with respect to the turret. Angle error limit sensors measure turret to truck base rotational motion.

The individual beam servo system allows a wide range of roof shapes, from roof sections involving sharp platform turns (low radius of curvature) to parallel platform sections. Exotic shapes such as winding platform path or arched platform path are possible. Certain platform transitions may require that the translational motion beam end and bearing channel have a round profile so that the beam may rotate somewhat about the beam axis relative to the turret. This is a requirement wherever significant loss of parallelism occurs between the platforms. Additionally, some applications may require that both beam ends be round where small beam rotation occurs relative to the trucks at both ends. In these instances collars on the round fixed beam end straddle the open channel preventing translation motion. The only overall requirement is that the variation in distance between platforms be small. Further simplification accrues from the fact that the bang-bang servo allows the same gear motor and rack-and-pinion to be used throughout. It is possible to configure paths where the two beam-end platforms are at different levels. The consequence of this, however, is that a component of beam/fabric weight can cause large forces/torques on truck clamps and attachments. This is an application design consideration.

In some applications fabric drape in the region of the platforms (during roof closing and opening) will contact physical obstructions in the facility if allowed. Shortening the drape by lessening the width of fabric sections is costly since additional beam assemblies are required. To avoid this a fabric raising means is required. In the preferred embodiment a vertical channel is connected to the beam where the fabric edge is to be raised. The channel length is somewhat greater than one quarter the fabric section width. Two lifting cables are used. One end of each cable is connected to the edge of the fabric at a distance of one quarter the fabric section width from the beams on each side. Each cable length is approximately three eighths the fabric section width. In one fabric lifting embodiment, a small motor with cable store pulley and ratchet, attached at the top of the vertical channel, is used to maintain cable tension. This motor is essentially run in blocked rotor mode between ratchet steps with sufficient torque to lift the fabric portion weight. In reverse, the ratchet is released and the fabric is lowered by virtue of the beam motion pulling against the cable. When the beam reaches the desired stop position on the platform the fabric lifting motor is de-energized. In the preferred passive (motor-less) embodiment, a small block-and-tackle means with a two-to-one lift ratio is attached at the top inside of each vertical channel. In each channel the associated lifting cable is threaded through the fixed top pulley, around the movable pulley and connected to the fixed block. A second set of cables are connected, one each, near the ends of the beams on each side of the fabric section. The length of each of these cables is somewhat larger than the associated fabric section width. For each of these cables a small block-and-tackle means with a four-to-one lift ratio is ganged to the two-to-one block-and-tackle attached at the top inside of the vertical channel. Each cable is threaded through a fixed top pulley, around a movable pulley, through the second fixed top pulley, around the second movable pulley and connected to the fixed block. The movable pulley block is connected to a weight sufficient to lift two times the sum of the weights of the fabric to be lifted plus the lifting cable and four times its beam connected cable weight. The movable pulley block and weight move inside the guiding vertical channel. Since the two block-and-tackle are ganged, the beam motion control cable mediates travel of the fabric lifting cable. For fabric lifting configurations fabric fold-enhancing seams, in addition to a normal center seam, are desirable.

Whether opening or closing a roof section, the associated beams are sequenced for motion by the central system controller circuitry in beam order 1 through N, where N is the beam closest to the non-moving end of the roof section. Partial closure is easily accomplished by stopping the motor drives at any point. By eliminating non-moving ends (i.e. beam N is the last beam in the section) selected portions of the open area may be covered. For each beam, a truck on one beam end contains a position sensor which detects position based on position indicators spaced along the platform. The central system controller communicates with the individual beam servo control circuits. Each servo control circuit may either be located with the central system controller or on its associated beam. Electrical cabling distribution means will vary according to location of control circuits. The central system controller will shut down all motor drives when any individual motor drive "over-current" condition is sensed or a manual shutdown is initiated.

A second preferred embodiment of this invention is an arched root or "two sided" configuration where roof slope is provided by arched beam structure. In one version of this embodiment truck-mounted short horizontal beams support an arched beam structure to which roof fabric is connected. These short support beams are inside the arch span. Truck and support beam operation is the same as with the one sided configuration. This two sided embodiment, however, requires large counterbalance weights suspended from the arch ends to prevent large applied torques to the truck clamps. In an alternate embodiment long support beams are located outside the arch upper span allowing the arch lower span, below the support beams, to supply the counterbalance weight. With either two sided embodiment, round beam ends are required at both ends to allow for small beam rotation. In addition use of fabric lifting means, previously described, is required with a vertical channel located at each arch peak so that the fabric peak is lifted during roof opening. As with the one sided configuration, need for lower edge fabric lifting is application dependent.

A third preferred embodiment of this invention combines features of the first and second embodiments. It provides a two sided roof slope from the peak by virtue of fabric cut such that only horizontal beams are required. Again, fabric lifting means at the roof peak near the horizontal beam center are required.

While it is envisioned that the majority of the applications of this invention will be in geographical regions and seasons where ice and snow are not a concern, it nevertheless must be addressed. Shielding most of the system components from ice and snow is either straightforward or not essential, however, this is not the case for the fabric cover. Two means are considered: one electro-thermal and the second chemo-thermal. The electrothermal embodiment uses resistance heating wire embedded in the fabric outer layer. Conventional AC power used for the system in general is used to power the resistance heating wiring. The chemo-thermal embodiment uses a deicing fluid. From a storage means the fluid is pumped, via tubing attached to the power cabling, to each beam along the length of which the fluid is sprayed onto the adjacent fabric. The fluid and melt are captured in a runoff gutter means and fed to a fluid separation means whence the fluid is returned to the storage tank. For facilities which are not weather sealed, use of heated air on the fabric underside can not be considered as an ice/snow melting solution. However, partial sealing (not hermetic) can be achieved with fabric panels attached using zippers or hook-and-loop fasteners.

DETAILED DESCRIPTION OF THE INVENTION

Figure 1:
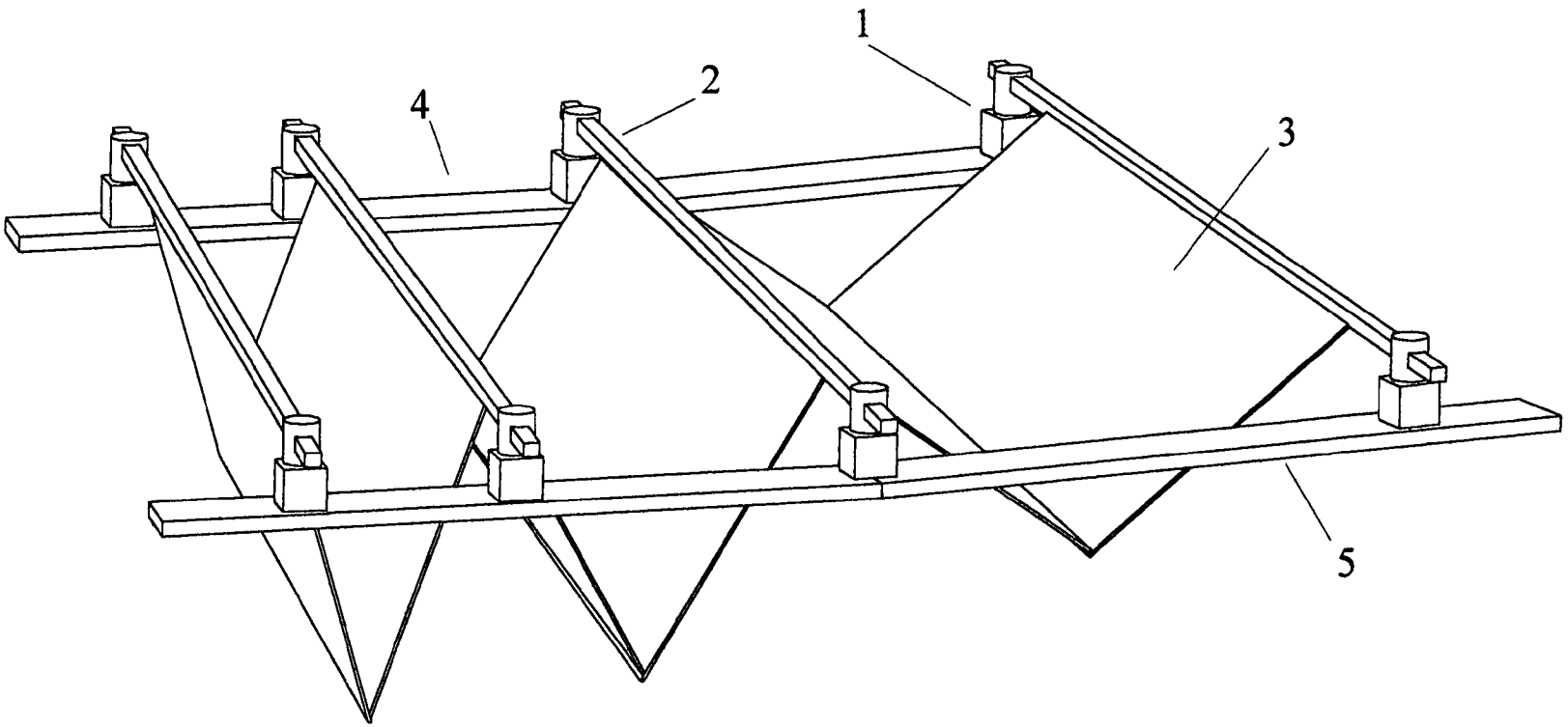
FIG. 1 shows the principle components of a fabric retractable roof in a frontal aspect of its simplest "one-sided" embodiment with horizontal beams.

In FIG. 1 a "one sided" embodiment of a fabric retractable roof whereby drainage is from one side of the roof is shown with its principle components. Each beam 2 of a set of essentially horizontal beams, is supported at both ends by electric-motor driven trucks 1. The material (wood, metal, plastic, etc.) and form (rectangular, I, T, channel, truss, etc.) of the beams are application dependant. The trucks ride on platforms, which for discussion purposes are called "inner" 4 and "outer" 5 normally based on platform radius of curvature, whose separation is essentially constant. Over the total length of a roof coverage area some platform sections may be parallel (infinite radius of curvature) or change their relative curvatures so that "inner" and "outer" becomes a label only. Fabric sections 3 are cut in width based on spacing between adjacent beams when the roof is closed. The cut is such that drainage be on one side and normally a center seam will guide folding. Attaching the fabric sections to the beam underside may be accomplished by one of numerous fabric retention methods. Fabric sections between beams need not be one-piece, but may consist of overlapping strips. These strips may be connected, if desired, using zippers or hook-and-loop fasteners. The fabric material may be any state-of-the-art type chosen for strength-to-weight ratio and water proof properties, e.g. Teflon-coated fiberglass.

Figure 2:
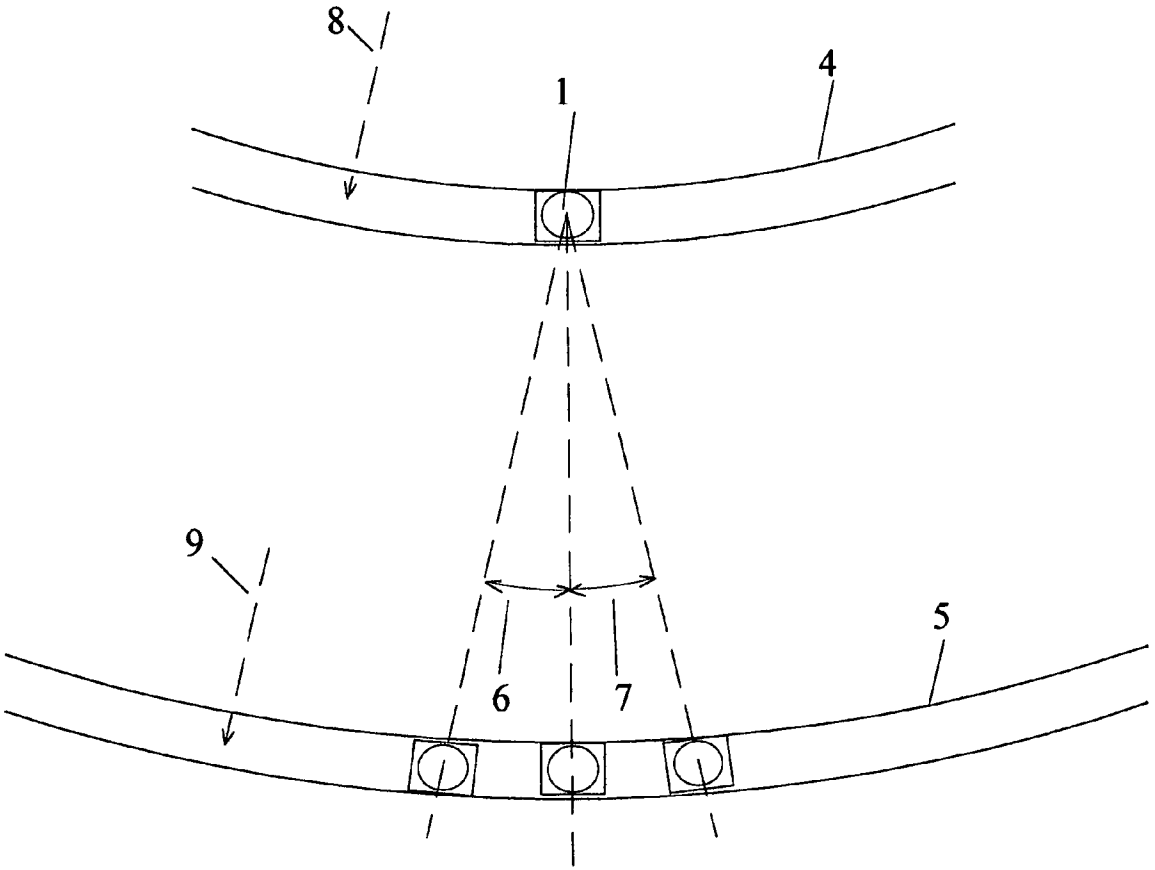
FIG. 2 shows the beam position angle error used by the servo control system.

Control of truck motors for each beam so that the beam ends stay essentially perpendicular to the path-tangent is a key element of this invention. The method is based on measuring the beam deviation angle from perpendicular as shown in FIG. 2. Here, the inner platform 4 has a radius 8 and the outer platform 5 has a radius 9. When small error angle limits, 6 and 7 (exaggerated here but typically under one degree), are detected between truck 1 on the inner platform and the corresponding outer platform truck, a bang-bang servo control system causes the leading truck motor to de-energize. For the outer platform truck, if the beam motion is right-to-left then 6 represents a lead angle error limit while for left-to-right motion 7 represents lead angle error limit. While small time-scale accelerations and decelerations are occurring the average velocity for the beam ends will be correct.

Figure 3:
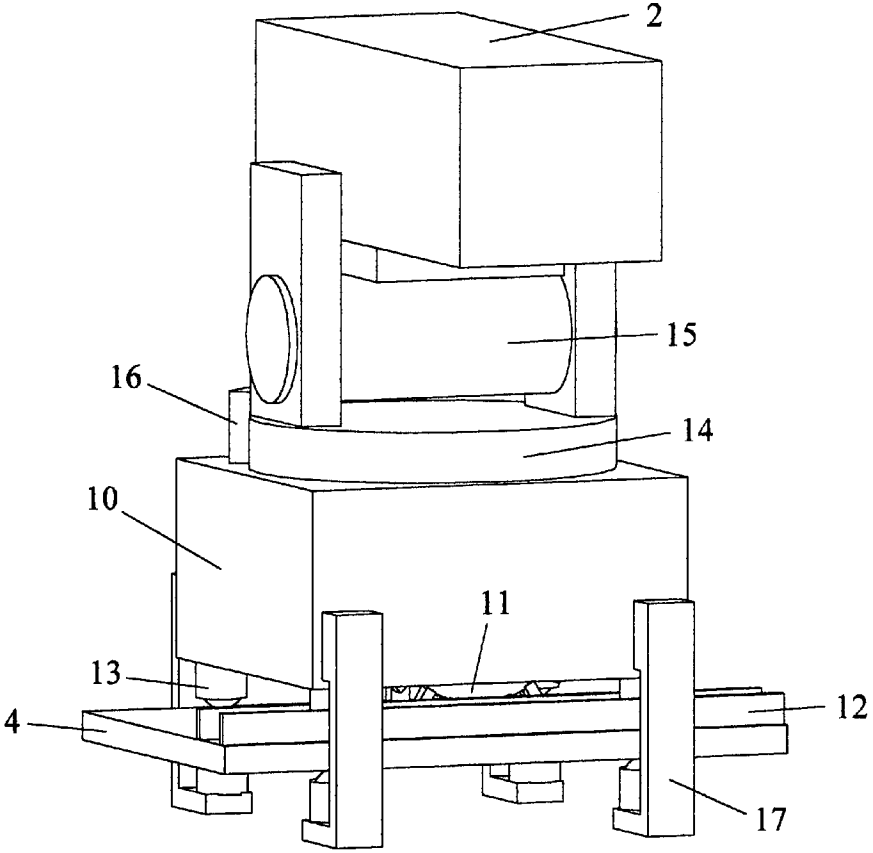
FIG. 3 shows an inner platform truck with its principle components, in a frontal aspect with cutaway of the platform and attached fixed beam.
Figure 4:
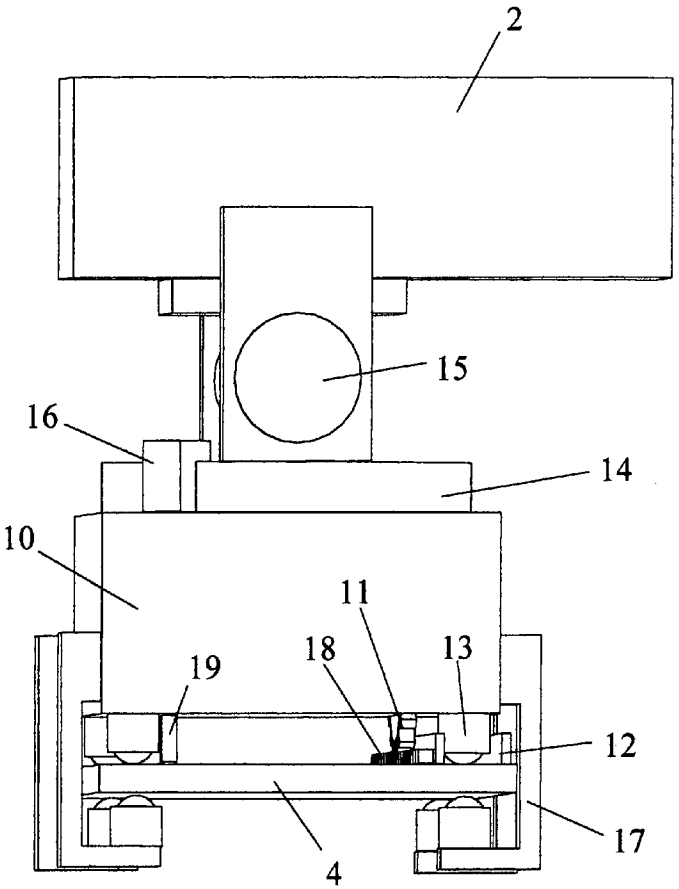
FIG. 4 shows an inner platform truck with its principle components, in a side aspect with cutaway of the platform and attached fixed beam.

An example truck embodiment associated with an inner platform is shown in FIG. 3. The beam end 2 is connected to the top of the truck on a pin-and bearing assembly 15 which can rotate in a vertical plane. This allows for small unintentional or intentional non-coplaner alignment of the inner and outer platforms. Large non-coplaner alignment of the platforms is not recommended since unbalanced side forces are introduced on the pin and hence truck. The beam attachment assembly rests on a rotatable turret bearing 14 which has the angle error detector unit 16 attached to its side. The detector will typically consist of switches (electromechanical, electro-optical, etc.) while the associated error limit sending unit is fixed mounted to the top of the truck base 10 beneath the detector. The truck base contains a drive motor and linkage. An AC gear motor is recommended for system simplicity. The preferred linkage is a pinion gear 11 with associated rack assembly (shown in FIG. 4 as 18) attached to the platform. In addition, the preferred roller/guide-path embodiment is glide-rollers 13 in a track 12. FIG. 4 also shows a beam position detector unit 19 attached to the bottom of the truck base while the associated position sending unit is fixed mounted on the top of the platform. Since high winds or system failures could cause sudden lifting of twisting forces on the truck, clamping means 17 are necessary.

Figure 5A:
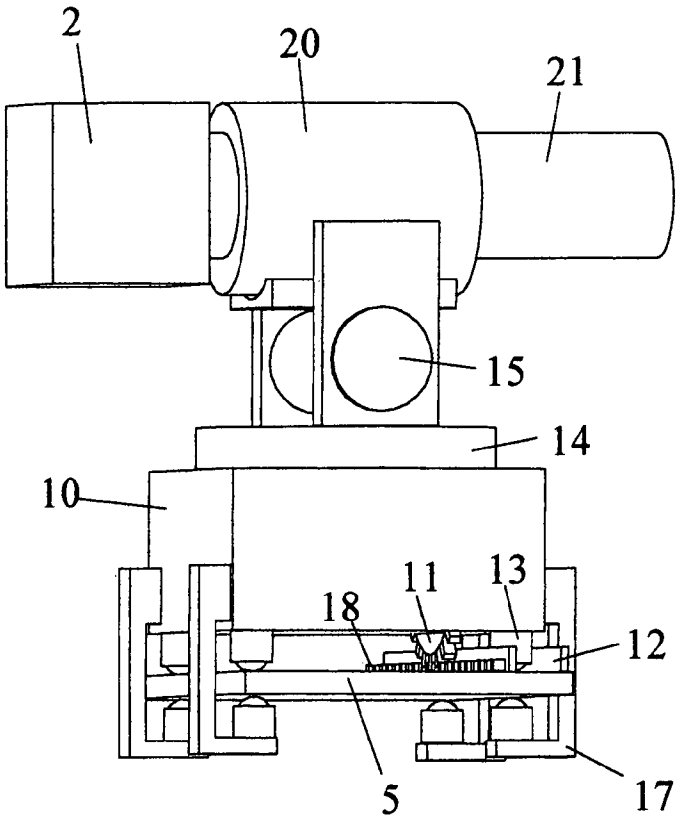
FIG. 5A shows an outer platform truck with its principle components, in a side aspect with cutaway of the platform and attached translatable beam.
Figure 5B:
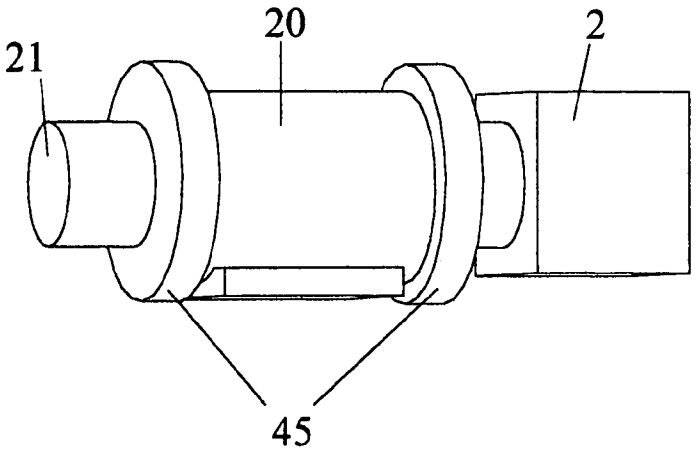
FIG. 5B shows a fixed beam with rounded end, allowing for beam rotation, whose collars prevent translation.

The result of small beam angle error is a requirement for beam length somewhat greater than the platform separation related perpendicular distance. Further, since this error varies continually then dynamically variable beam length must be accommodated. The preferred solution is shown in the outer platform truck assembly of FIG. 5A. Here the beam 2 has a round end 21 which passes through a collar channel and bearing 20 allowing the beam length to adapt to the angle error. The round beam end and collar has the additional role of allowing rotation of the beam end about its axis, necessary during unintentional or intentional transition in platform levels. The collar channel and bearing assembly is connected to a pin and bearing assembly 15 similar to the inner platform truck. These complement each other allowing small beam motion in a vertical plane. The remainder of the outer platform truck is the same as the inner platform truck, however angle error detection and beam position detection are not necessary. In certain applications where torsional forces on the entire beam can occur, such as the "two-sided" roof embodiments discussed later, it is necessary that both beam ends be round and rotatable. However, since the inner platform beam end should not be translatable, collars 45 shown in FIG. 5B are required to be fixed to the round end 21 and straddle the collar channel and bearing 20. This prevents beam translation while permitting beam rotation at the inner platform truck.

Figure 6:
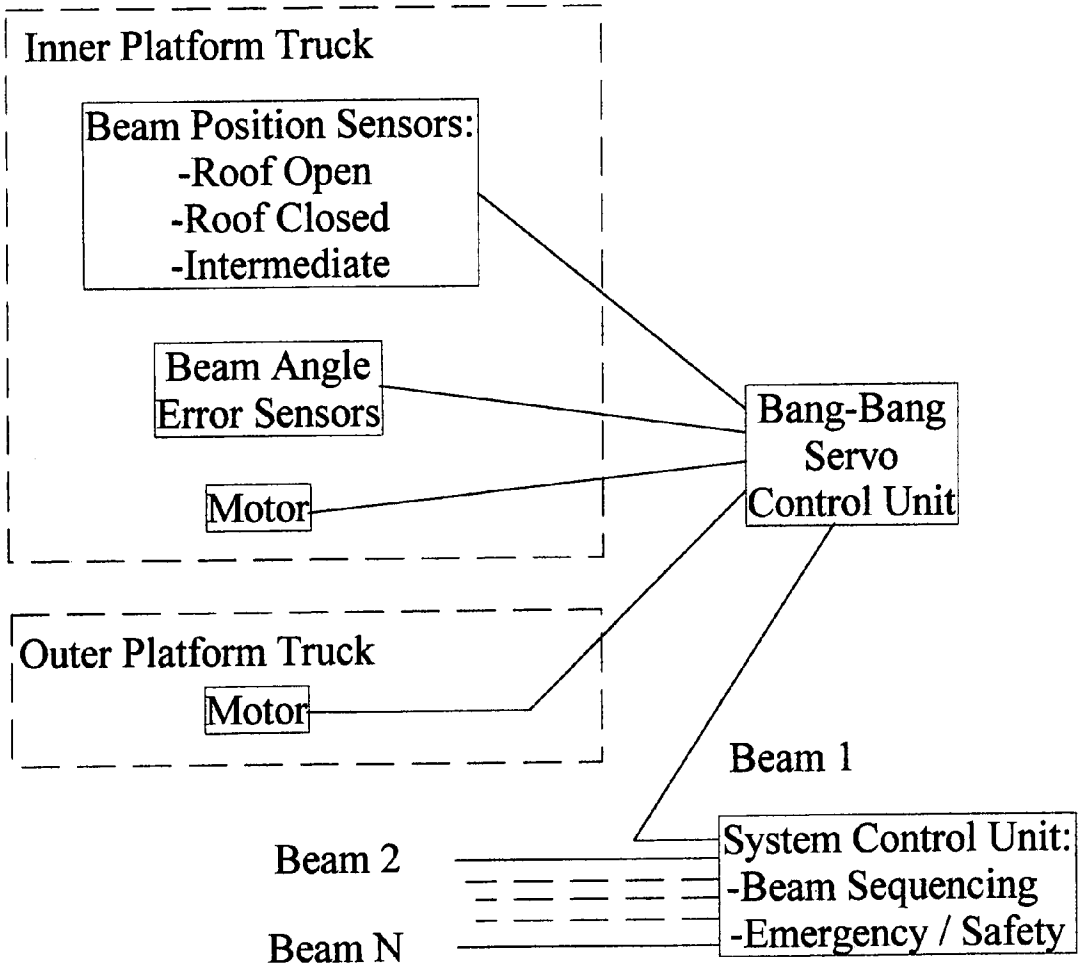
FIG. 6 shows a block diagram of the retractable roof control system elements.

Regarding the retractable roof as a system broadens the scope of system components to include control functions. These are summarized in the block diagram of FIG. 6. The System Control Unit incorporates circuitry performing system operator interface for manually selected coverage area, manual startup, status display, manual overrides, automatic beam sequencing on startup of roof closure or opening and emergency shutdown based on motor overload. The System Control Unit is connected to each beam Servo Control Unit which receives functional commands, handles beam position and angle error sensor signals for motor control, and feeds back status data. Physically, the Servo Control Units can be co-located with the System Control Unit or located on the individual beam trucks. This decision is application dependent. Flexible electrical cable means connect on-beam to off-beam circuitry and between beams if required. In FIG. 6 it is assumed that sensors are located on the inner platform truck which is consistent with earlier assumptions.

Figure 7A:
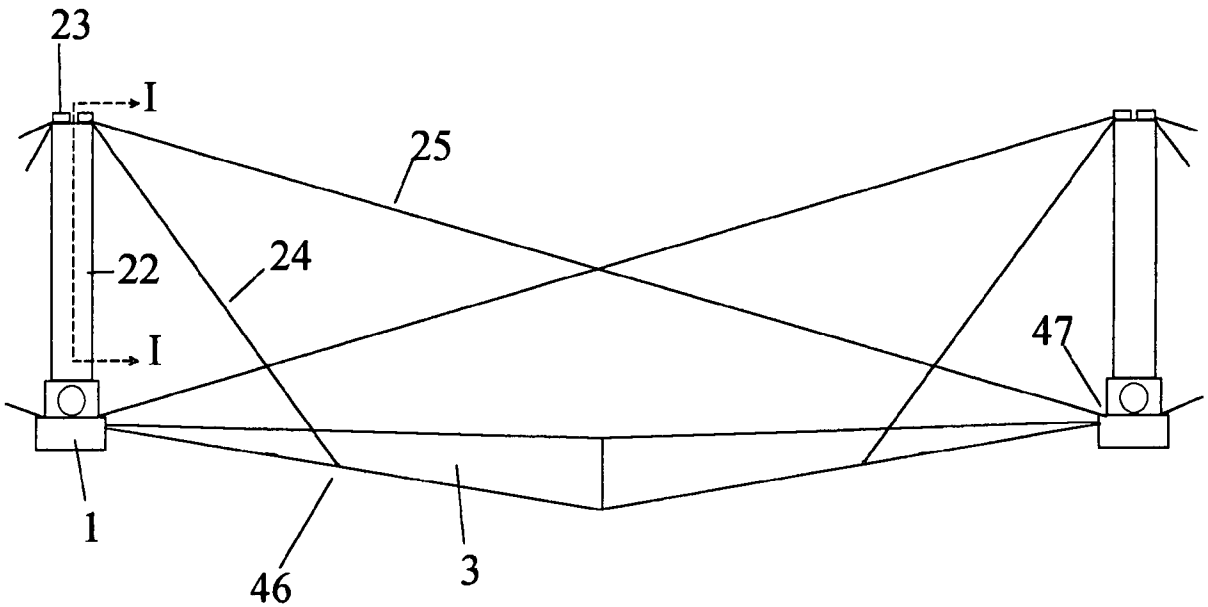
FIG. 7A shows a side view of a passive fabric lift means including cables and block-and-tackle guide channel.
Figure 7B:
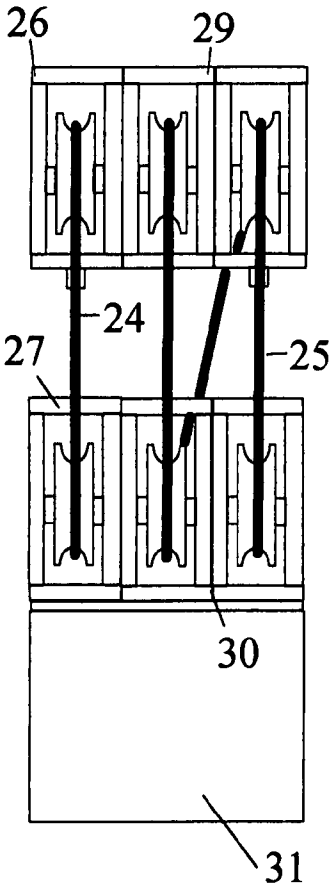
FIG. 7B shows a cutaway frontal view of the block-and-tackle and weight inside the guide channel.
Figure 8:
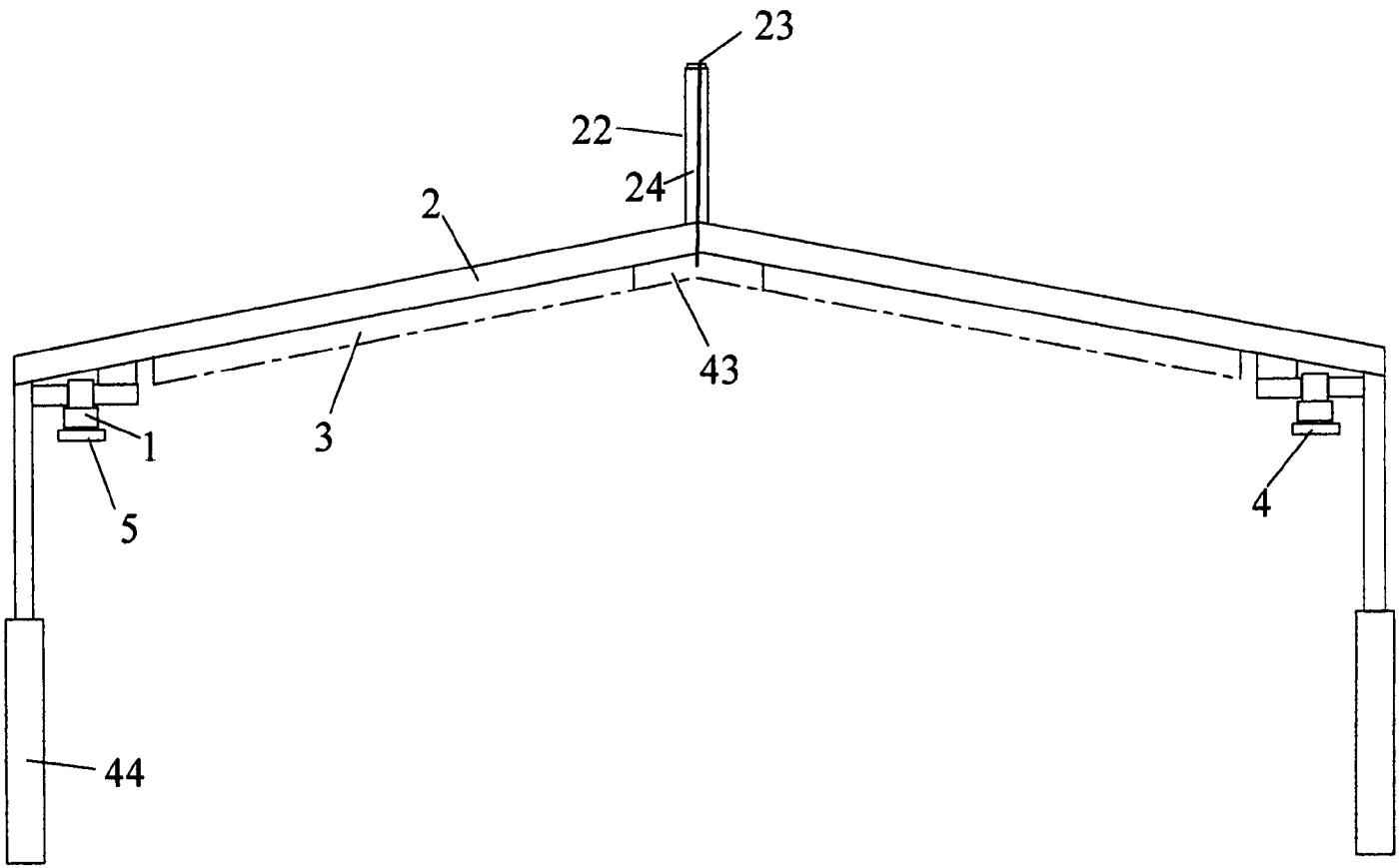
FIG. 8 shows a frontal cutaway view of a "two-sided" retractable roof embodiment including sloped beams with internal platforms and counterbalance weights.
Figure 9:
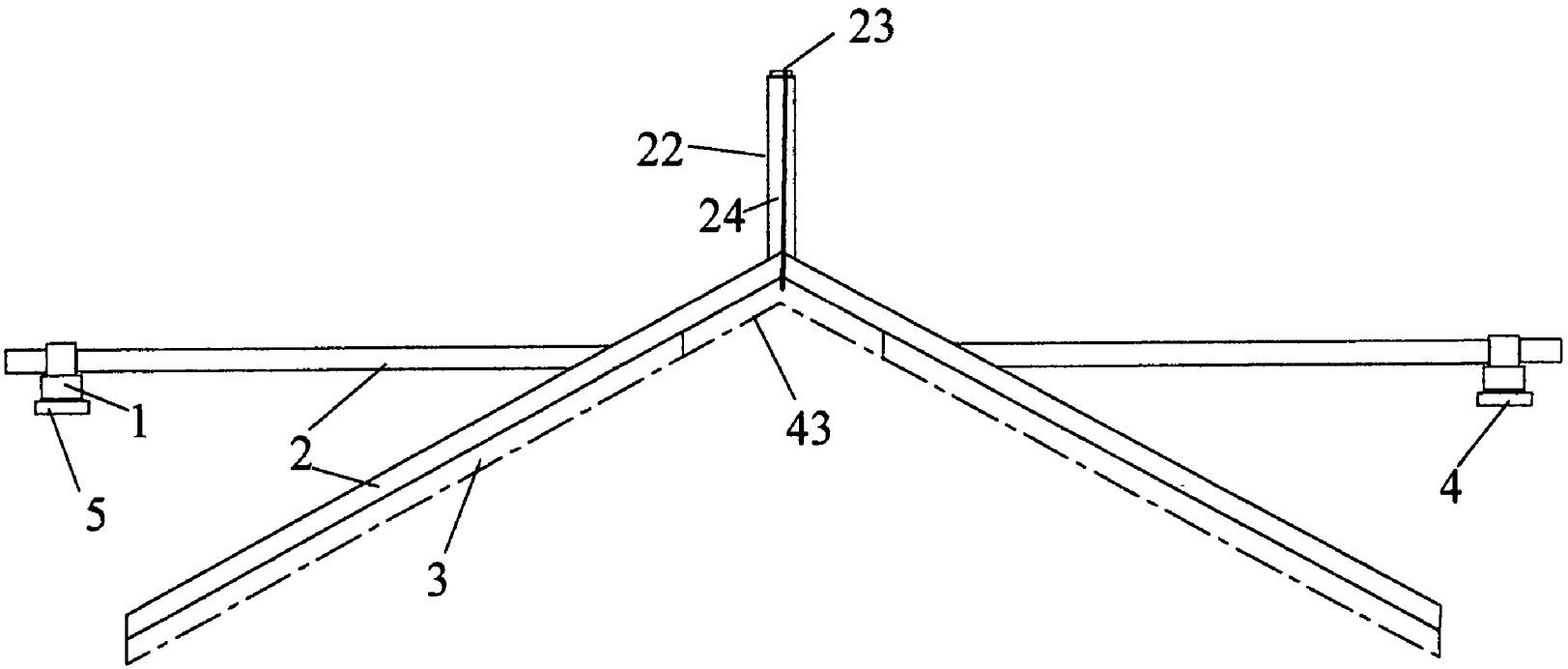
FIG. 9 shows a frontal cutaway view of a "two-sided" retractable roof embodiment including sloped beams with external platforms and horizontal beam supports.
Figure 10:
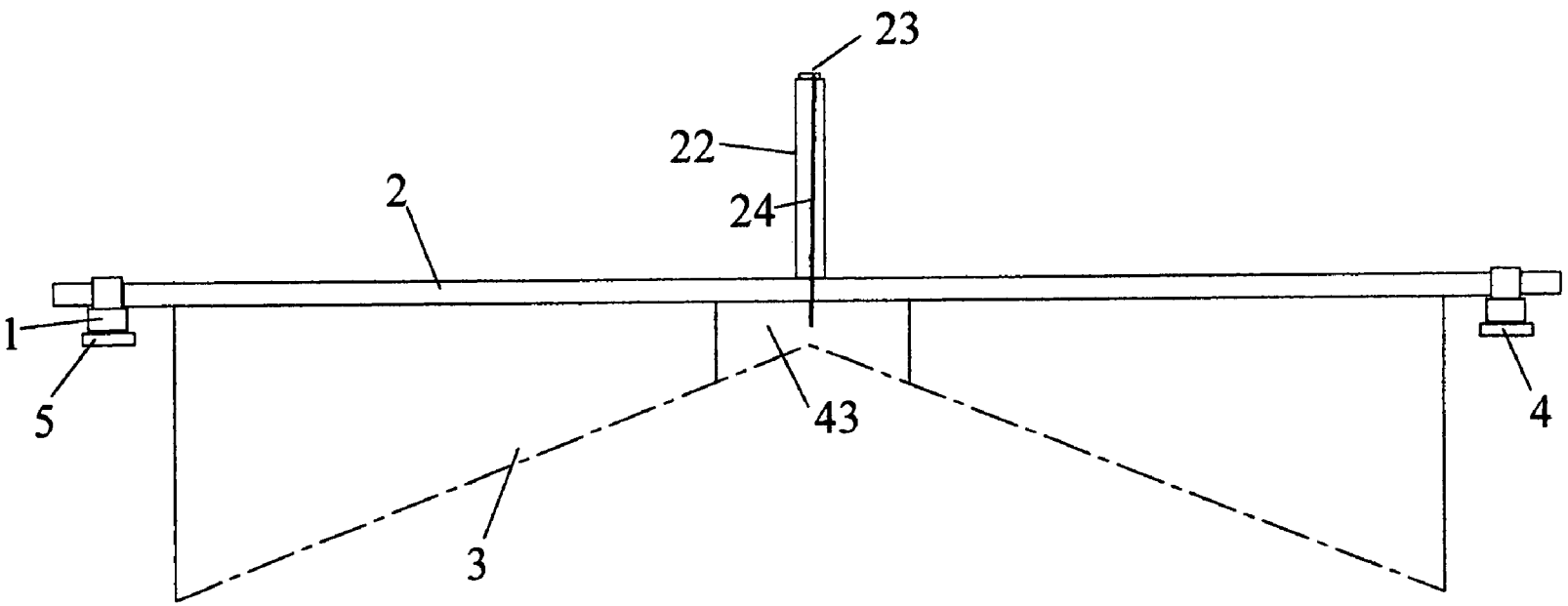
FIG. 10 shows a frontal cutaway view of a "two-sided" retractable roof embodiment with horizontal beams and fabric cut slope.

As implied in FIG. 1 a significant cable drape can occur when the retractable roof is being opened. The potential exists in certain applications for undesirable contact between fabric and objects inside the facility. To prevent this contact the fabric must be lifted. The preferred embodiment of the fabric lifting method is shown in FIG. 7A where, in this case, the lower edge of the fabric 3 is to be lifted. The fabric lift connection point 46 is approximately one-quarter the width of the fabric at the lift edge or line measured from the closest beam attachment point. A vertical channel 22 whose height is somewhat greater than one-quarter the width of the fabric to be lifted is attached to the beam at a position nearest to the fabric lift point. In this roof closed position a cable 24, whose exposed length is approximately three-eighths the width of the fabric to be lifted, has one end attached to the fabric lift point and the other connected to a two-to-one block-and-tackle at the top 23 of the vertical channel. A second cable 25 has one end connected to the beam near the opposite end of the fabric section and the other end connected to a four-to-one block-and-tackle also at the top of the vertical channel. FIG. 7B, a cutaway view I-I from FIG. 7A, shows that the two block-and-tackle are ganged together. The cable 24 is fed around its fixed block 26 pulley, through the movable block 27 pulley and up to the fixed block. The cable 25 is fed around its first fixed block 29 pulley, through the first movable block 30 pulley, up and around the second fixed block pulley, through the second movable block pulley, and up to the fixed block. In the closed roof position shown, the movable block is at its top position. Based on the mechanical advantage of the two ganged block-and-tackle the lifting weight 31 must be somewhat in excess of twice the weight of the fabric to be lifted plus cable 24, plus four times the weight of cable 25. Because of the ganged configuration cable 25 will mediate the motion of the weight and hence the fabric. As shown in FIG. 7A, identical lifting components are established at the adjacent beam. The result is that throughout opening and closing of the roof the cable drape stays nominally constant. To facilitate folding from the lift points, additional seams in the fabric are desirable.

Where roof symmetry and drainage from two sides is desired, there are three basic preferred "two sided" embodiments. The first is shown in the cross-section view of FIG. 8. Beams 2 provide the roof slope for drainage from the fabric 3. Because of the roof peak, folding of the fabric in the open roof condition requires lifting of the peak fabric section 43. This is accomplished using the lifting means previously described with vertical channel 22, block-and-tackle 23, and lifting cable 24 shown. Fabric section 43 overlaps the sections on each side below and is not attached to them. Additional use of lifting means near the fabric edges is application dependent. This beam structure configuration has a high center-of-gravity relative to the pivoting beam ends supported on the trucks, if not properly compensated. Lowering the center-of-gravity for stability is accomplished with suspended weights 44. An alternate sloped beam roof is shown in the cross-section view of FIG. 9. In this second "two sided" embodiment the sloping beams 2 themselves provide the stable center-of-gravity based on horizontal support beams 2 connected at a relatively high point on the sloped beams. The third "two sided" embodiment is shown in the cross-section view of FIG. 10. In this embodiment the support beam 2 is horizontal so that drainage is based on the cut of the fabric 3, as with the "one sided" embodiment. Here, as with all "two sided" embodiments, a roof peak fabric section 43 lifting means is required.

Figure 11:
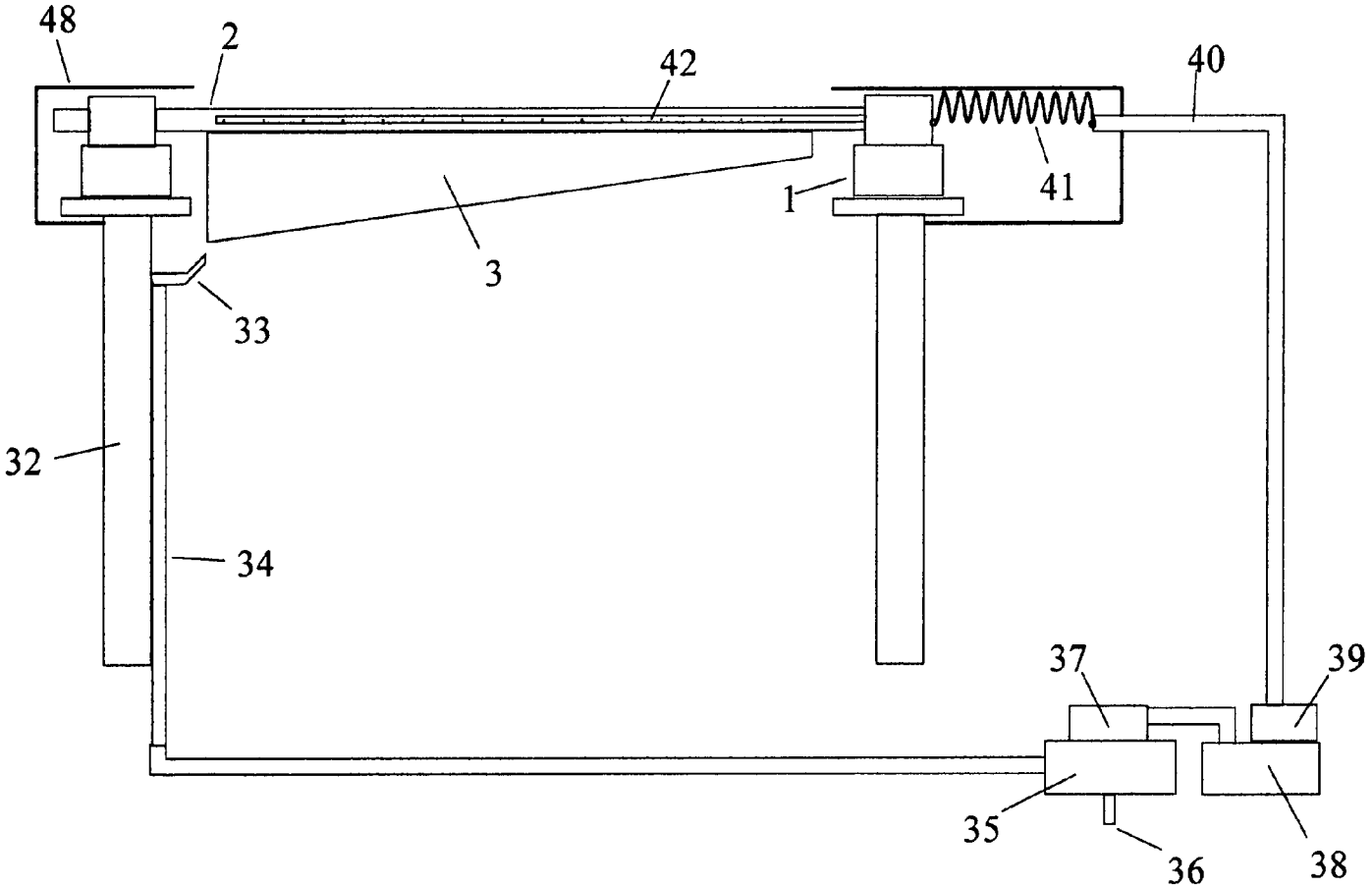
FIG. 11 shows a frontal cutaway view of a retractable roof with deicing drainage and chemical recycling system.

While it is expected that the vast majority of applications of this invention will not require operation where snow and ice conditions exist, there are means to enable such operation. One such embodiment is shown in FIG. 11 where a "one sided" roof example is used. Here the ice/snow melting means is chemical in the form of circulating deicing solution. The solution, held in reservoir 38, is sent via pump 39 through fixed pipe 40 and flexible pipe 41 to fluid distribution pipe 42 on the beam 2. Flexible pipe 41 basically follows the same path as the electrical cables to beam 2. Fluid distribution pipe 41 straddles the beam and supplies a continuous spray flow of deicing fluid to the fabric via holes in the side of the pipe. Collection of all runoff is made by gutters 33 and sent by pipes 34 to water/deicer separation processor 36. Separation processing will used established means (evaporation, specific gravity, etc.) based on the specific deicing fluid. Separated deicer is sent via pump 37 back to reservoir 38, while separated water is sent to the gravity drain 36. An alternate snow/ice melting means uses electrical resistance wire embedded in the fabric. Wire heating power is the standard AC power used by the roof electrical system. Runoff, in this case, is water only. For the comfort and/or protection of people, animals and plants in the covered facility, means of forming non-hermetic closure between the roof fabric and support walls/columns 32 is possible using zippers or hook-and-loop fasteners. With such closure, internal facility air heating may be achieved providing a third means of roof snow/ice melting. Platform covering is provided by shield means 48.

Various systems, methods and apparatuses are described herein including:

(A) A retractable fabric roof system based on: a plurality of facility spanning substantially horizontal beams of fixed span length each supporting fabric sections which are cut to provide precipitation runoff slope on one side, each beam end supported by a truck which moves in guide rail means on a platform and powered by an electric motor located in the truck base, said truck motion controlled by a servo system providing proper average velocity according to the truck's local path, turrets located atop each truck base allowing for small rotational deviations of the associated beam from its ideal path where small resulting linear deviation of span length is allowed via a round beam end slip-collar bearing assembly in one beam end turret, while small roll motion of each beam is allowed by having both beam ends round and in roll bearings, and small beam tilt is allowed by a tilt bearing on each turret.

There is also described herein (B) a central control circuitry providing: beam power sequence-enabling at roof open/close startup; beam motion direction switching for open/close; beam motor off/brake enabling at selected travel limit; motor overcurrent shut-down; manual over-rides; a bang-bang servo system to control average velocity of each beam in (A), beam angle error being measured with respect to the perpendicular to the path tangent, for each beam angle error limit detection being based on a switch activation at the turret/truck-base interface on one beam end, said switch activation causing motive power to the leading truck motor to be removed while maintaining motive power to the lagging truck motor, said motors being reversible single phase ac gear motors with power controlled through solid state devices, with selected beam travel limit switch activation occurring at the associated truck base/platform interface.

There is also described herein (C) a fabric lift means to prevent fabric drape during roof opening/closing resulting in interference with proper fabric folding due to self-interference or contacting objects in the spanned facility, based on a vertical channel assembly whose height is somewhat in excess of one quarter the associated fabric section width and which is attached to each beam near the fabric edge to be lifted, said channel containing a two-to-one block-and-tackle means attached to the channel top whereby one end of a lifting cable is threaded through the pulleys and connected to the fixed block while the other cable end is attached to the associated fabric edge at a distance from the beam at approximately one quarter the fabric width; said channel also containing a four-to-one block-and-tackle means whereby one end of a control cable is threaded through the pulleys and connected to the fixed block while the other cable end is attached to the associated adjacent beam end; the two block-and-tackle means being ganged together with a fabric and cable lifting weight suspended from the joint moveable block thereby allowing the beam connected cable to control the motion of the fabric lifting cable.

There is also described herein (D) a retractable fabric roof using the means of (A), (B), and (C) whose fabric supporting beams are arch shaped providing liquid runoff on two sides, said arched beam extending over and beyond the truck support platform on each side and being stabilized by counterbalancing weight symmetrically disposed on each side of the arch below the platform level, and whose roof peak fabric section uses the lifting means of (C).

There is also described herein (E) a retractable fabric roof using the means of (A), (B), and (C) whose fabric supporting beams are arch shaped providing liquid runoff on two sides, said arched beam connected to horizontal support beams connected high on the arch shaped beam sides resulting in a stable weight distribution, said horizontal support beams extending beyond the arched beam and connected to trucks in a manner similar to (A), and whose roof peak fabric section uses the lifting means of (C).

There is also described herein (F) a retractable fabric roof using the means of (A), (B), and (C) using horizontal support beams similar to (A) but whose two sided liquid runoff is allowed by the fabric cut on each side, and whose roof peak fabric section uses the lifting means of (C).

There is also described herein (G) a snow/ice melting capability in the form of either resistance heating wire embedded in the outer layer of fabric sections where heating power is provided from the standard ac system power, or a deicing fluid supply/recovery system consisting of: deicing fluid reservoir, pumps, plastic supply tubing flexibly connected to the moving beams with the electrical cables, deicer spray lines connected to the beam sides, plumbing to route all fluid from drain gutter means to deicer recovery means and separated deicer back to the reservoir.

I claim:

1. A retractable roof system comprising:

a first elongated track;

a second elongated track disposed adjacent to said first elongated track, said second elongated track being spaced apart from said first elongated track;

a set of spaced apart beams including a first beam, said retractable roof being adapted so that each beam of said set of beams is arranged in a direction generally in parallel with an adjacently disposed beam and extends generally transversely between said first elongated track to said second elongated track, the set of beams supporting a flexible cover for covering an area below said flexible cover;

a pair of trucks for supporting said first beam of said set of beams on said first and second elongated tracks, the pair of trucks including a first truck supporting a first end of said first beam on said first elongated track and a second truck supporting a second end of said first beam on said second elongated track; and a motor for moving said first truck along said first elongated track;

wherein said first truck supports said first beam in such manner that said first beam is capable of moving (a) linearly in a direction along said first elongated track; (b) rotationally about an axis extending vertically from said first elongated track; and (c) linearly in a direction of said first beam, and wherein said first truck includes (i) a pin and bearing assembly allowing rotation of said first beam about an axis extending in a direction generally in parallel with said first elongated track; and (ii) a collar channel and bearing assembly receiving said first beam and allowing rotation of said first beam about an axis of said first beam.

2. The retractable roof system of claim 1, wherein said flexible cover includes a plurality of fabric sections.

3. The retractable roof system of claim 1, wherein said roof system is adapted so that said retractable roof system can at least one of (a) impart an upward pulling force on said flexible cover while said plurality of beams are moved along said first and second elongated tracks and (b) supply a flow of deicing fluid to said flexible cover.

4. The retractable roof system of claim 1, wherein said set of tracks varies in elevation along its length.

5. The retractable roof system of claim 1, wherein each of said first elongated track and said second elongated track is curved as seen from a top view.

6. A retractable roof system for covering an area, said retractable roof system comprising:

a first elongated track;

a second elongated track disposed adjacent to said first elongated track, said first elongated track and said second elongated track defining a set of tracks;

a plurality of beams supporting a flexible cover, the plurality of beams including a first beam and being disposed adjacent to one another in a transverse orientation relative to said first and second elongated tracks, wherein said retractable roof system is adapted so that said plurality of beams are moved along said first and second tracks for changing between a first state in which said flexible cover covers said area and a second state in which said flexible cover does not cover said area; and a first set of trucks carrying said first beam, the first set of trucks including a first truck disposed on said first elongated track for supporting a first end of said first beam and a second truck disposed on said second elongated track for supporting a second end of said first beam;

wherein said retractable roof system is adapted so that a distance between said first truck and said second truck while said first beam is moved along said track is a variable distance;

wherein at least one of said first truck and said second truck includes a collar bearing assembly adapted to slidably receive said first beam in such manner that said first beam can move along an axis of said first beam within said collar channel bearing assembly so that variations in said distance while said first beam is moved along said first and second elongated tracks is accommodated; and wherein each of a beam end of said first beam and said collar channel bearing assembly includes a round profile to allow rotation of said first beam about an axis of said first beam.

7. The retractable roof system of claim 6, wherein said set of tracks varies in elevation along its length.

8. The retractable roof system of claim 6, wherein each of said first elongated track and said second elongated track is curved as seen from a top view.

9. The retractable roof system of claim 6, wherein said roof system is adapted so that said retractable roof system can impart an upward pulling force on said flexible cover while said plurality of beams are moved along said first and second elongated tracks.

10. The retractable roof system of claim 6, wherein said roof system is adapted so that said retractable roof system can supply a flow of deicing fluid to said flexible cover.

11. A retractable roof system for covering an area, said retractable roof system comprising:

a first elongated track;

a second elongated track disposed adjacent to said first elongated track, said first elongated track and said second elongated track defining a set of tracks;

a plurality of beams supporting a flexible cover, the plurality of beams including a first beam and being disposed adjacent to one another in a transverse orientation relative to said first and second elongated tracks, wherein said retractable roof system is adapted so that said plurality of beams are moved along said set of tracks for changing between a first state in which said flexible cover covers said area and a second state in which said flexible cover does not cover said area;

a first set of trucks carrying said first beam, the first set of trucks including a first truck disposed on said first elongated track for supporting a first end of said first beam and a second truck disposed on said second elongated track for supporting a second end of said first beam;

a second set of trucks carrying a second beam disposed adjacently with respect to said first beam, the second set of trucks also including a first truck disposed on said first elongated track for supporting a first end of said second beam and a second truck disposed on said second elongated track for supporting a second end of said second beam;

a first motor assembly for moving said first beam along said set of tracks; and a second motor assembly for moving said second beam along said set of tracks;

wherein said retractable roof system is adapted so that said first motor assembly for moving said first beam along said set of tracks is controlled responsively to a first sensed condition;

wherein said second motor assembly for moving said second beam along said set of tracks is controlled responsively to a second sensed condition, the second sensed condition being different than said first sensed condition and wherein said retractable roof system includes a lifting apparatus capable of lifting said flexible cover while said plurality of beams are moved along said first and second elongated tracks.

12. The retractable roof system of claim 11, wherein each of said first elongated track and said second elongated track are substantially straight and disposed in substantially parallel relation to one another.

13. The retractable roof system of claim 11, wherein said first motor assembly includes more than one motor.

14. The retractable roof system of claim 11, wherein said retractable roof system is adapted so that retractable roof system can supply a flow of deicing fluid to said flexible cover.

15. The retractable roof system of claim 14, wherein said retractable roof system is adapted so that said flow of deicing fluid is supplied through first and second fluid distribution pipes that are disposed adjacent to said first and second beams respectively.

16. The retractable roof system of claim 11, wherein said first sensed condition is an angle of said first beam.

17. The retractable roof system of claim 11, wherein said set of tracks varies in elevation along its length.

18. The retractable roof system of claim 11, wherein each of said first elongated track and said second elongated track is curved as seen from a top view.

19. The retractable roof system of claim 11, wherein said lifting apparatus includes a cable.

20. The retractable roof system of claim 11, wherein said lifting apparatus includes a pulley.

21. The retractable roof system of claim 11, wherein said lifting apparatus includes a block and tackle.

* * * * *